US009871294B2

(12) United States Patent
Forster

(10) Patent No.: US 9,871,294 B2
(45) Date of Patent: Jan. 16, 2018

(54) DUAL BAND RFID DEVICE AND METHOD OF FORMATION

(71) Applicant: Avery Dennison Retail Information Services LLC, Westborough, MA (US)

(72) Inventor: Ian James Forster, Essex (GB)

(73) Assignee: AVERY DENNISON RETAIL INFORMATION SERVICES, LLC, Mentor, OH (US)

( * ) Notice: Subject to any disclaimer, the term of this patent is extended or adjusted under 35 U.S.C. 154(b) by 215 days.

(21) Appl. No.: 14/551,270

(22) Filed: Nov. 24, 2014

(65) Prior Publication Data

US 2015/0077297 A1 Mar. 19, 2015

Related U.S. Application Data

(63) Continuation of application No. 13/048,957, filed on Mar. 16, 2011, now Pat. No. 8,917,214.

(51) Int. Cl.

| | |
|---|---|
| ***H01Q 5/00*** | (2015.01) |
| ***H01Q 7/00*** | (2006.01) |
| ***H01Q 13/10*** | (2006.01) |
| ***H01Q 5/20*** | (2015.01) |

(52) U.S. Cl.

CPC ..... *H01Q 5/001* (2013.01); *H01Q 5/20* (2015.01); *H01Q 7/00* (2013.01); *H01Q 13/10* (2013.01); *Y10T 29/49018* (2015.01)

(58) Field of Classification Search

CPC .. H01Q 1/2208; H01Q 1/2216; H01Q 1/2225; H01Q 1/27; H01Q 1/273; H01Q 1/38; H01Q 7/00; H01Q 1/52; H01Q 1/526; H01Q 7/005; H01Q 7/04

See application file for complete search history.

(56) References Cited

U.S. PATENT DOCUMENTS

| | | | | |
|---|---|---|---|---|
| 5,495,250 | A | 2/1996 | Ghaem et al. | |
| 6,466,176 | B1 | 10/2002 | Maoz et al. | |
| 6,836,215 | B1 | 12/2004 | Laurash et al. | |
| 7,098,850 | B2 * | 8/2006 | King | B65D 5/4233 340/572.1 |
| 7,298,330 | B2 * | 11/2007 | Forster | G06K 19/07749 343/700 MS |
| 7,534,477 | B1 | 5/2009 | Waggoner et al. | |
| 7,750,792 | B2 | 7/2010 | Smith et al. | |
| 7,765,728 | B1 | 8/2010 | Waggoner | |
| 7,810,267 | B2 | 10/2010 | Saint et al. | |
| 8,174,454 | B2 * | 5/2012 | Mayer | H01Q 1/2225 343/725 |

(Continued)

*Primary Examiner* — Tho G Phan
*Assistant Examiner* — Patrick Holecek
(74) *Attorney, Agent, or Firm* — Avery Dennison Retail Information Services, LLC

(57) ABSTRACT

A dual band antenna device and method of formation is provided. In one embodiment, the method comprises providing a planar conductive sheet; forming a slot antenna in the conductive sheet; the slot antenna configured to communicate at a first frequency; forming a multi-turn antenna in the conductive sheet; the multi-turn antenna configured to communicate in a second frequency that is different from the first frequency; and connecting at least one integrated circuit to said first antenna and said second antenna; enclosing said first antenna, said second antenna, and said at least one integrated circuit in a wearable enclosure.

13 Claims, 7 Drawing Sheets

(56) References Cited

U.S. PATENT DOCUMENTS

| | | | | |
|---|---|---|---|---|
| 8,556,182 | B2 * | 10/2013 | Stobbe | G06K 19/07749 235/435 |
| 8,917,214 | B2 * | 12/2014 | Forster | H01Q 7/00 343/728 |
| 2006/0266831 | A1 * | 11/2006 | Kozlay | G06K 19/07345 235/451 |
| 2007/0205867 | A1 | 9/2007 | Kennedy et al. | |
| 2008/0068177 | A1 | 3/2008 | Copeland | |
| 2008/0179404 | A1 | 7/2008 | Finn | |
| 2010/0001079 | A1 * | 1/2010 | Martin | G06K 19/07749 235/492 |
| 2010/0230500 | A1 | 9/2010 | Wilkinson | |

* cited by examiner

DUAL BAND RFID DEVICE AND METHOD OF FORMATION

CROSS-REFERENCE TO RELATED APPLICATIONS

The present application is a continuation of U.S. Priority application Ser. No. 13/048,957 filed Mar. 16, 2011 which is incorporated herein by reference in its entirety.

FIELD OF THE INVENTION

The present invention is directed to radio frequency identification devices and, more particularly, to a dual band radio frequency identification device.

BACKGROUND OF THE INVENTION

Radio frequency identification (RFID) devices, also sometimes known as inlays, comprise an integrated circuit and an antenna. An RFID device is in an intermediate configuration which must then undergo one or more manufacturing operations in order to complete the RFID tag, label or other enclosure housing the RFID device.

RFID tags and labels are widely used to associate an object with an identification code. RFID tags and labels generally have a combination of antennas and analog and/or digital electronics, which may include, for example, communications electronics, data memory, and control logic.

In many applications it is desirable to employ an RFID device that operates in multiple frequency bands such as High Frequencies (HF) and Ultra High Frequencies (UHF). In some applications such as medical applications, it may desirable for persons to wear the RFID device, which may be integrated into a wristband or other wearable item. Thus, it would be desirable to manufacture such dual band RFID devices in a wearable item, such a wristband, in a cost effective and efficient manner using current manufacturing technologies such as laser technology to create the antennas. These and other advantages may be provided by one or more embodiments of the present invention.

BRIEF DESCRIPTION OF EXAMPLE EMBODIMENT

The present invention provides a dual band antenna device and method of formation. In one embodiment, the method comprises providing a planar conductive sheet; forming a slot antenna in the conductive sheet; the slot antenna configured to communicate at a first frequency; forming a multi-turn antenna in the conductive sheet; the multi-turn antenna configured to communicate in a second frequency that is different from the first frequency; and connecting at least one integrated circuit to said first antenna and said second antenna; enclosing said first antenna, said second antenna, and said at least one integrated circuit in a wearable enclosure.

BRIEF DESCRIPTION OF THE DRAWINGS

The invention is further described in the detailed description that follows, by reference to the noted drawings by way of non-limiting illustrative embodiments of the invention, in which like reference numerals represent similar parts throughout the drawings. As should be understood, however, the invention is not limited to the precise arrangements and instrumentalities shown. In the drawings, which are not necessarily to scale.

DETAILED DESCRIPTION OF ILLUSTRATIVE EMBODIMENTS

The present invention is now illustrated in greater detail by way of the following detailed description which includes the best presently known mode of carrying out the invention. However, it should be understood that this description is not to be used to limit the present invention, but rather, is provided for the purpose of illustrating the general features of the invention.

In the following description, for purposes of explanation and not limitation, specific details are set forth, such as particular materials, antennas, antenna shapes, interposer shapes, integrated circuits, assembly configurations and locations, etc. in order to provide a thorough understanding of the present invention.

However, it will be apparent to one skilled in the art that the present invention may be practiced in other embodiments that depart from these specific details. Detailed descriptions of well-particular materials, antennas, antenna shapes, interposer shapes, integrated circuits, assembly configurations and locations are omitted so as not to obscure the description.

Figure 1:
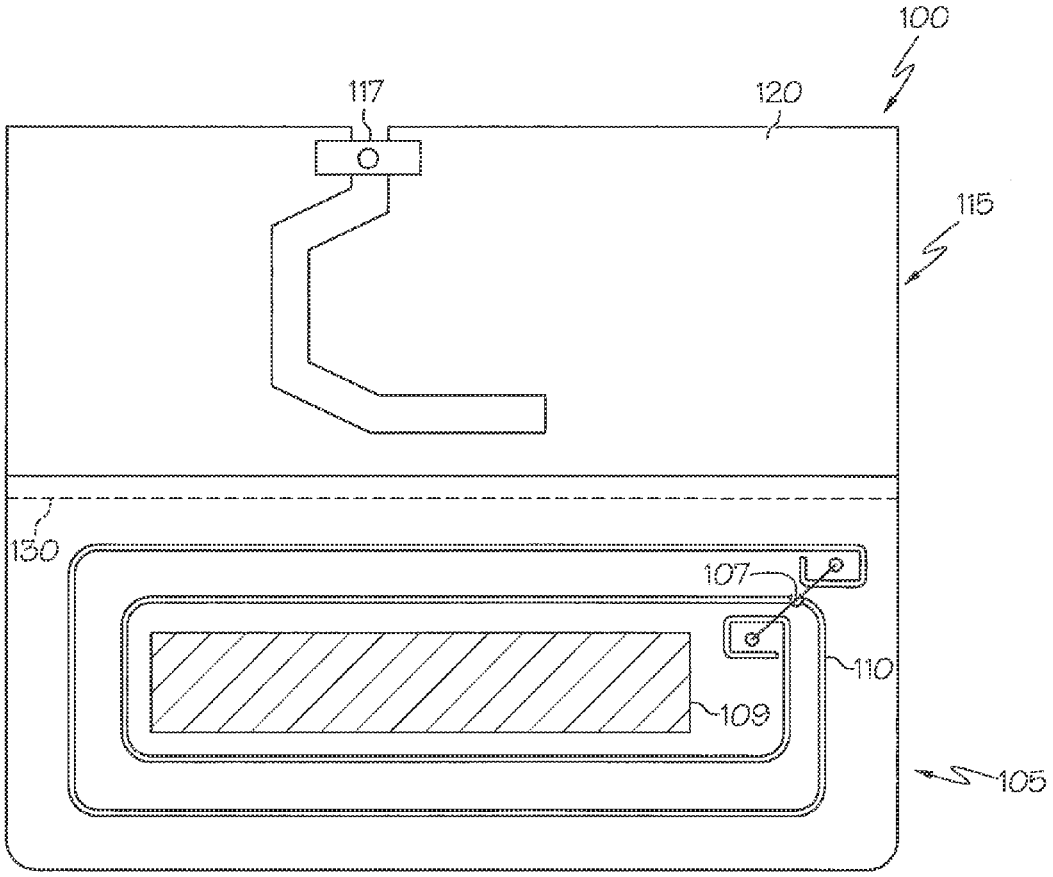
FIG. 1 is a plan view of an RFID device according to an example embodiment of the present invention.
Figure 2:
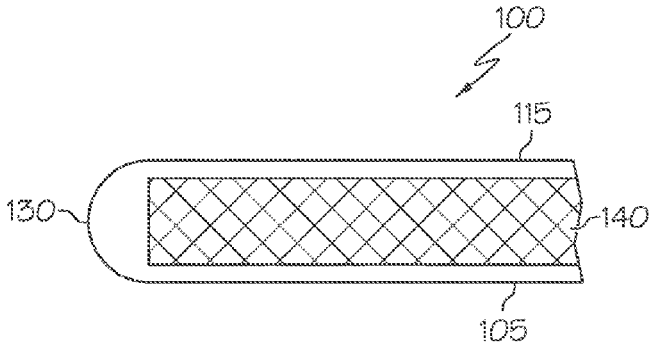
FIG. 2 is a partial cross-sectional view of the RFID device of FIG. 1 after being folded.

Embodiments of the present invention provide a dual mode RFID device that communicates in two or more frequency bands such as at HF and UHF. FIGS. 1 and 2 illustrate an example embodiment of the present invention, which includes a HF inlay 105 and an UHF inlay 115. The HF inlay 105 comprises an HF antenna 110 and RFID integrated circuit 107. The HF antenna 110 (indicated by the spiral shaped line) comprises a multi-turn or coil antenna. The UHF inlay 115 comprises an UHF antenna 120 and RFID integrated circuit 117. The UHF antenna 120 of this embodiment comprises a slot antenna such as shown in U.S. Pat. No. 7,298,343 which is commonly assigned with the instant application herewith. The HF inlay 105 and UHF inlay 115. are attached to a separator 140 to form an RFID assembly 100. The assembly 100 is created flat for ease of manufacture and then folded along fold line 130 to position the separator 140 between the UHF and HF antenna structures. In this example embodiment, two RFID integrated circuit are used. In other embodiments, one RFID integrated circuit with two ports to be connected to each of the two antennas may be used.

The RFID integrated circuits 107 and 117 may include a processor, memory devices, and other suitable structures for controlling and/or regulating communication with external devices (such as readers and/or detectors), through sending and/or receiving signals through their respective antennas 110 and 120. Functions of the integrated circuits 107 and 117 may be carried out by circuitry of the integrated circuit, using a variety of well-known electronic structures. The integrated circuits 107 and 117 may be directly connected to the antennas 110 and 120, or may alternatively be coupled to the antennas 110 and 120 using an intervening structure such as an interposer or strap. Such an interposer or strap may have conductive leads that facilitate electrical connection between the integrated circuits and the antennas 110 and 120. Such electrical connection may be an electrical connection direct contact, characterized by a low electrical resistance, or alternatively a reactive electrical connection, where the contact is via an electric field, a magnetic field, or a combination of such fields.

In another embodiment in which only a single integrated circuit is used (and connected to both antennas), the RFID integrated circuit may be a two-port integrated circuit capable of being attached to both of the antennas 110 and 120 for communications through both at the same time. The RFID integrated circuit may include circuitry to choose the antenna 110 or 120 with which to communicate. The selection may be made based on external signals, or may be made automatically, for example based on which of the antennas 110 or 120 receives a stronger signal. Alternatively the energy from the two antennas can be combined to provide power and data communications to the integrated circuit.

In this embodiment, the HF inlay 105 (i.e., the HF antenna 107) functions as a ground plane/isolator for the UHF inlay, to prevent the dielectric properties of a material, such as a persons arm if the tag was used in a wristband, that the combined tag is attached to from affecting the UHF antenna. By its nature, the HF antenna is relatively insensitive to dielectric effects as, for a coil a small fraction of a wavelength in dimensions, it couples via primarily magnetic fields to a reader device. To perform this task effectively the HF inlay should include as large an area of conductor as possible. This can be achieved by making a coil that occupies the entire space between the outer edge and the centre. Alternatively an area of conductor 109 may be positioned at the center of the antenna 110 to further enhance such functionality. In the preferred embodiment the conductor 109 is the same conductor as used to form coil 110. The area of conductor 109 may be connected electrically to the coil at one or more points around its edge. In an alternate embodiment, area 109 may be patterned by a suitable means into a structure with a series of elements resonant at UHF frequencies. The effectiveness of this embodiment may be enhanced by constructing the turns of the HF antenna 110 to have a very narrow gap between turns, such as those produced by laser cutting, which may make the antenna appear as a solid plane at UHF frequencies.

The HF antenna acts as an isolator or ground to the UHF inlay and therefore provides a "shield" to reduce or eliminate sensitivity of the UHF inlay to objects on the other side of the ground plane (i.e., the HF antenna). For example, the HF Tag/ground plane may be on the inside of the wristband (adjacent the wearer's skin) and shield the UHF RFID device from the different dielectric constant that that wearers skin may have on the RFID device. The presence of the HF Tag/ground plane between the UHF inlay antenna and objects which may variably affect operation of the RFID device, may aid in reducing or preventing interaction of such objects and the working components of the UHF RFID device.

The thickness or the dielectric characteristic of the separator 140 (a dielectric layer) may be selected so as to prevent undesired interaction between the ground plane and the antenna configuration. In one example embodiment for use with UHF frequencies, a foam separator 140 may be 0.5 mm thick so that when folded the thickness is 1 mm thick.

When the assembly 100 is folded, the HF antenna assembly (the HF antenna 110, the plate 109, and any other shielding) may be co-extensive with the UHF antenna 120 so as to provide appropriate shielding to the operative parts of the RFID device. In other embodiments, the HF antenna assembly (the HF antenna 110, the plate 109, and any other shielding) may be extend laterally (further than the UHF antenna 120) around the entire perimeter of the UHF antenna 120 or may extend laterally (further than the UHF antenna 120) along one or more sides of the UHF antenna 120. In still other embodiments, the HF antenna assembly (the HF antenna 110, the plate 109, and any other shielding) may not be co-extensive, and the UHF antenna 120 may extend laterally (further than the HF antenna 110) around the entire perimeter of the HF antenna 110 or extend laterally (further than the HF antenna 110) along one or more sides of the HF antenna 110. In this example embodiment, the HF antenna assembly (the HF antenna 110, the plate 109, and any other shielding) is substantially co-extensive with the UHF antenna 120 meaning that the [ ] HF antenna assembly shields (i.e., is co-extensive with) at least ninety percent of the surface area of the UHF antenna 120.

Figure 3A:
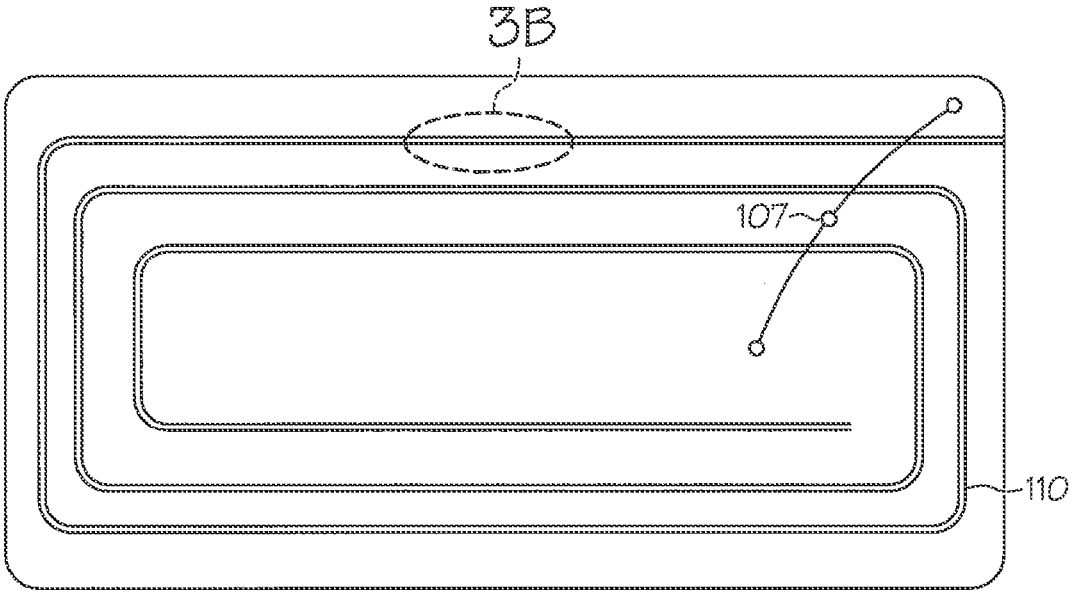
FIG. 3*a* is a plan view of an antenna according to an example embodiment of the present invention.
Figure 3B:
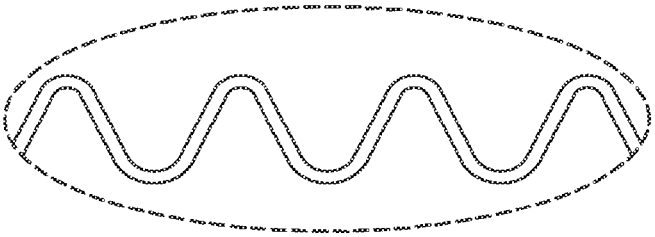
FIG. 3*b* is a plan view of a portion of an antenna according to an example embodiment of the present invention.

FIGS. 3*a* and 3*b* illustrate a method of increasing the coupling between elements of the HF antenna 110 by introducing areas with increased adjacent area, such as wave shaped (that results in a wave style gap between antenna turns) or inter-digital cuts. In FIG. 3*a*, the cuts between turns of the antenna 110 are represented by the lines and the turns themselves are represented by the space between such lines. These wave shapes may be placed along all of the cut (i.e., the entire coil of the antenna) or may be placed at intervals related to the wavelength of the UHF signal, such as at intervals of 1/10th of the wavelength, to more effectively break up any slot modes in the HF structure and make the HF antenna act more as a solid plane at UHF. FIG. 3*b* shows a portion of the HF antenna 110 of FIG. 3*a*. The antenna portion in 3*b* shows the wave shape present in at least a portion of the HF antenna 110 of FIG. 3*a*.

Figure 4:
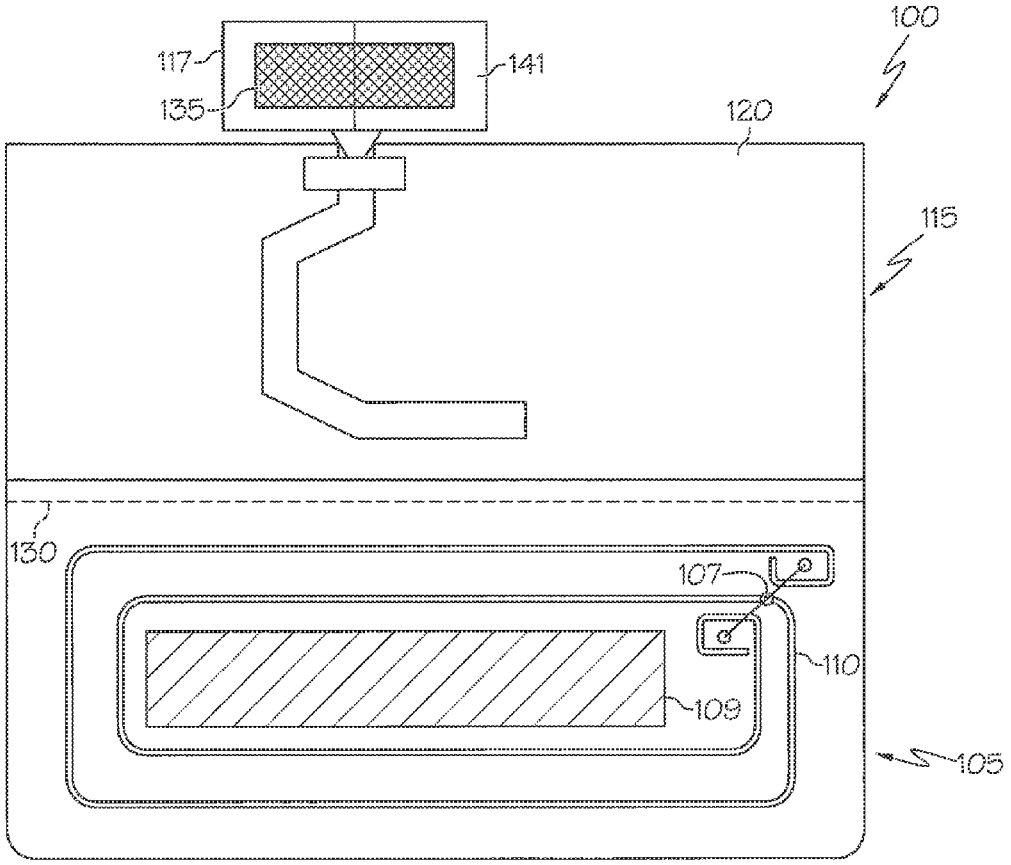
FIG. 4 is a plan view of a RFID device according to another example embodiment of the present invention.

FIG. 4 illustrates another example embodiment in which an additional connection is made to the UHF integrated circuit. This additional connection, such as that provided by the G2il+chip made by NXP semiconductors, can change a bit in memory of the inlay based on the electrical status of the extra connections. In this embodiment, a pressure sensitive material 135, such as a compressible conductive foam is placed over the contact area switch pads 141, so that when a user of the device (e.g., a wristband) applies pressure, the digital state stored in memory of the integrated circuit is altered. This function could be used to request an action from an external system; for example, in a theme park, to request that a photograph is taken from inside a display of the user, and stored in a web accessible manner based on the tag identification (ID), or to request assistance. An alternate embodiment may use an inter-digital structure so that when a person's finger or thumb applies pressure, the dielectric constant of the person's pressure changes the capacitance altering the detected switched state. Thus, instead of a compressible conductive foam, a dielectric material may be used.

Figure 5:
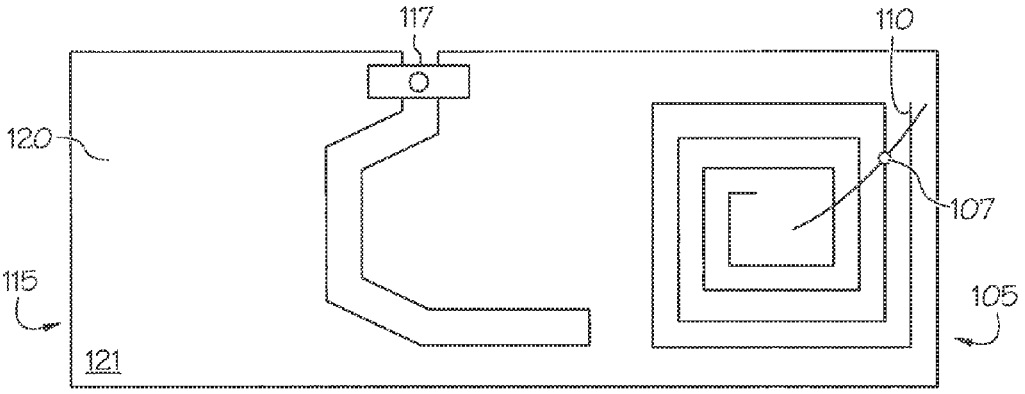
FIG. 5 is a plan view of a RFID device according to yet another example embodiment of the present invention.

FIG. 5 illustrates another embodiment that includes an alternate arrangement of antenna where the HF and UHF antennas are "merged." The spiral line of FIG. 5 indicates the very narrow gap between conductive turns of the HF antenna 110. Thus, the UHF and HF antenna are formed of the same conductive element 121. As described above, the narrow cut width between antenna turns (of antenna 110) and special features of the gaps in the HF antenna 110 allow the HF antenna 110 to act as an extension to the UHF antenna (as opposed to folding the assembly and the HF antenna 110 functioning as a shield or isolator to the UHF antenna 120). The structure may be backed with a foam separator (or other substrate) which may have a foil backplane either under the UHF antenna 120 only or under both antennas.

Figure 6A:
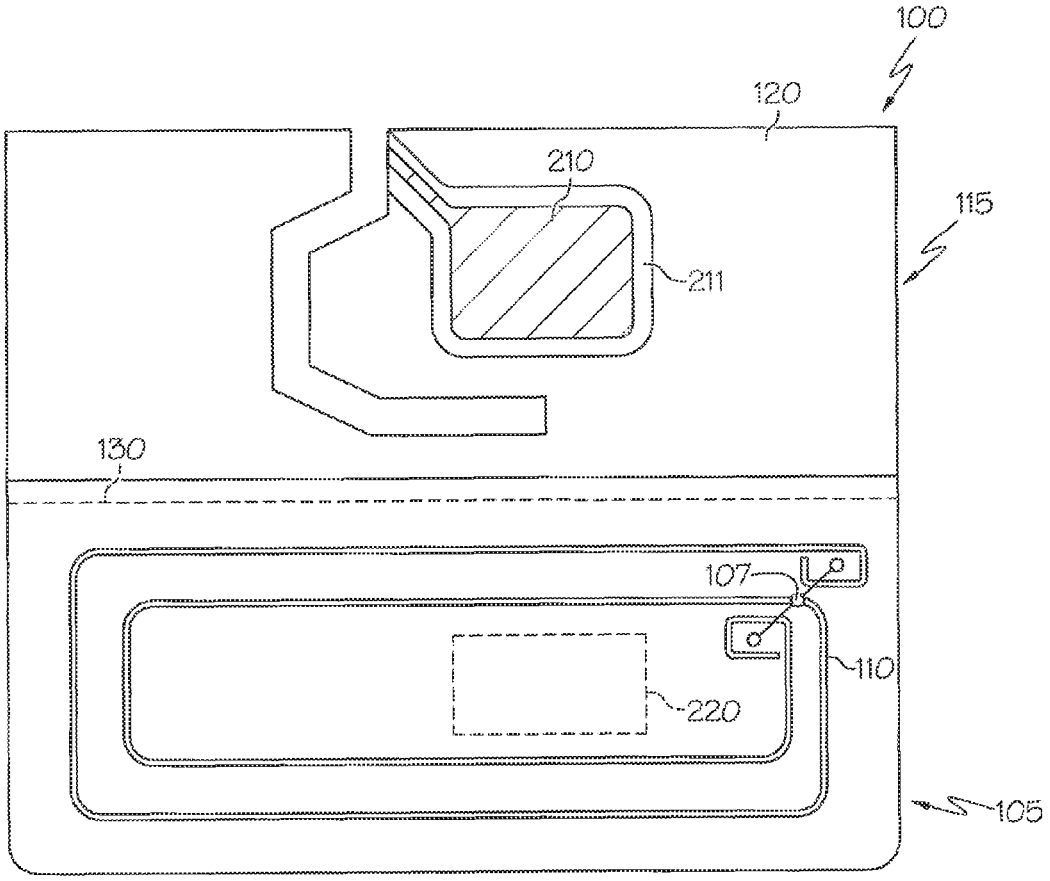
FIGS. 6*a* and 6*b* illustrate an RFID device according to still another example embodiment of the present invention.
Figure 6B:
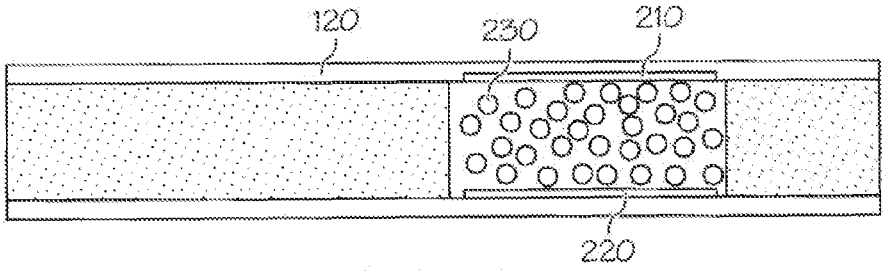

FIGS. 6 and 6*a* show an alternate embodiment where the folded structure is used to contain an electrolyte gel between two areas of dissimilar metal, forming a battery. This battery may be formed of low cost materials, such as aluminum 210. The aluminum foil sits on an insulating substrate such as PET or paper, 211 is a gap in the foil defining the top electrode. The foam layer has a cavity containing the electrolyte, so when folded up the set of layers is as follows; PET, aluminum 210, electrolyte gel 230, printed carbon 220, PET. A connection between 220 and the RFID chip must exist, in 6*a* via the UHF antenna, so that the voltage developed between 220 and 210 is applied to the chip. and a printed carbon 220, and may allow the UHF inlay 115 to operate in a longer range battery assisted passive mode for a defined time, such as for twelve hours (e.g., the maximum time a person would spend at a theme park or attraction). To allow the battery to be activated as desired the electrolyte may be contained in some form of structure that ruptures under pressure, such as a series of plastic spheres 230, so that when a wristband is attached to the person (or otherwise activated), the battery is activated. Thus the electrolyte gel may be contained in a pressure sensitive container configured to rupture upon application of a predetermined pressure.

Figure 7A:
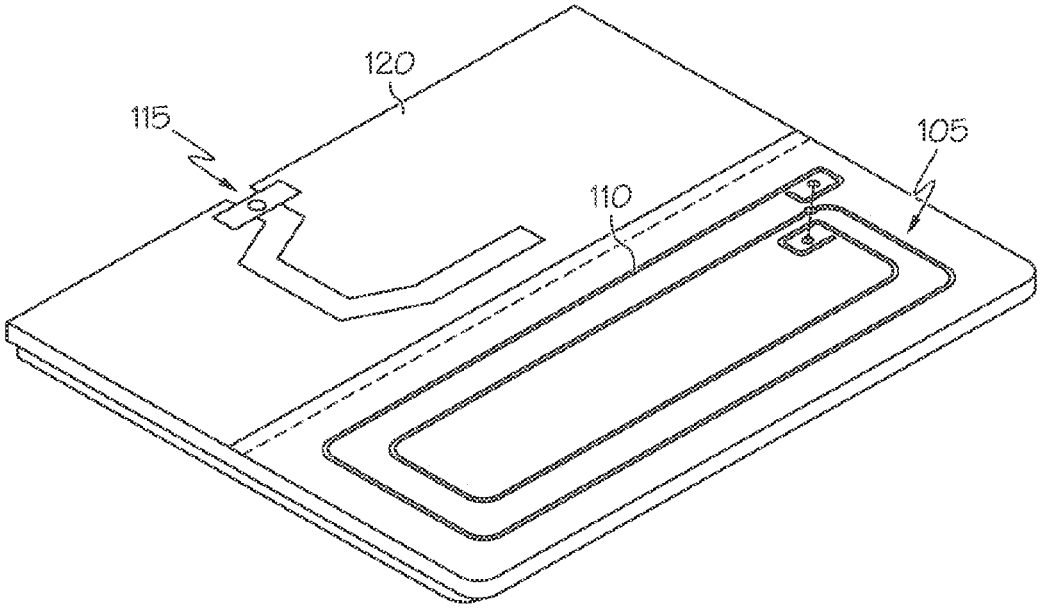
FIGS. 7*a* and 7*b* illustrate a method of manufacturing a RFID device according to an example embodiment of the present invention.
Figure 7B:
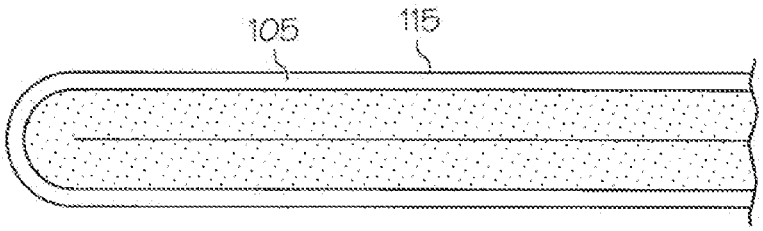
Figure 8:
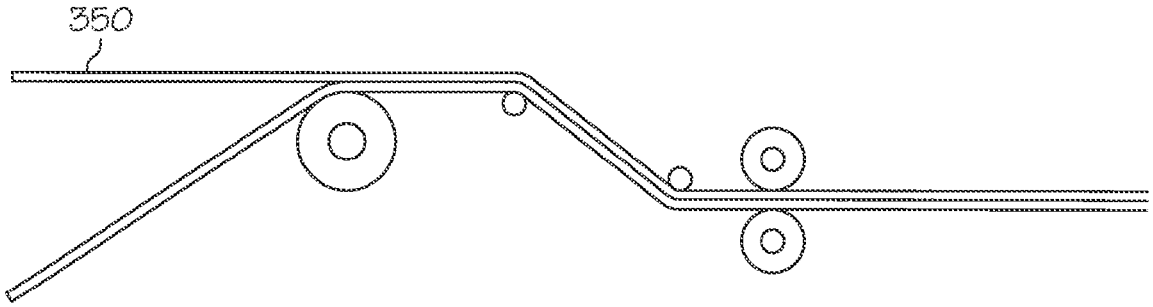
FIG. 8 illustrates a method of manufacturing a RFID device according to an example embodiment of the present invention.

FIGS. 7*a*, 7*b*, and 8 illustrate an example method of making an example dual mode RFID device. In this example embodiment, the UHF antenna 120 and HF antenna 110 are constructed flat (i.e., cut into a flat conductive sheet 350 or roll) and subsequently laminated with a flexible substrate such as a foam, paper or corrugated cardboard. Each antenna section (comprising the two antennas) may be cut from the sheet 350 or roll and folded (if applicable). A turn bar may be used to fold the structure over forming the desired stack structure as shown in FIG. 7*b* with an adhesive applied to maintain the assembly in the stack structure. When 105 is folded under 115 and the adhesive bonds the parts together, inherently one dimension, such as width or length, is reduced, as a portion of the device has been folded out of plane, but the thickness of the total structure is the sum of the two parts folded on top of each other.

Figure 9:
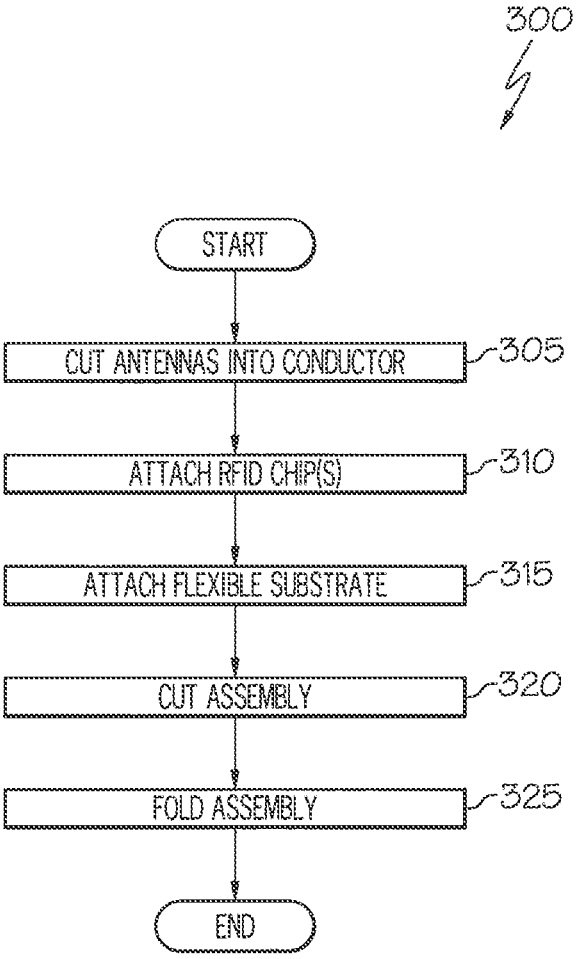
FIG. 9 illustrates a method of manufacturing a RFID device according to an example embodiment of the present invention.

FIG. 9 illustrates a method 300 of making an example dual band RFID device 100 according to an example embodiment of the present invention. In order to facilitate production of the antenna for the RFID device, it is useful to form the antennas from a pre-formed conductive material sheet 350 or roll as shown in FIG. 8. The conductive material sheet may be a unitary, monolithic, continuous conductive material sheet. The conductive material 350 may be planar, and may be in sheet, web, or roll form.

At 305, the antennas are formed (i.e., cut, slit or otherwise physically separated) in the conductive material sheet, with the cutting (or slitting or separating) locations selected to provide suitable characteristics for the antenna. This enables properties of the antenna to be tailored to a desired performance of the antenna, and/or to allow the antenna to function well in an environment where the RFID device is to be used. In one example embodiment, the process includes cutting the conductive material sheet 350 using laser technology and may include wave cuts in one of the antennas (e.g., the HF antenna). In other embodiments, the antennas may be formed through printing operations such as by printing of conductive ink. Thus, examples methods include providing a sheet of conductive material in which a plurality of pairs of antenna are provided (with each pair of antennas residing in a separate section of the conductive material).

At 310 the RFID integrated circuit(s) may be placed by any of a variety of suitable placement methods, to transfer the integrated circuit(s) (or an interposer or strap including the integrated circuit) from a sheet or roll having multiple chips or interposers, to a suitable location in connection with the antennas to form an RFID assembly. As an alternative, the RFID integrated circuit(s) may be placed using a pick-and-place operation.

At 315, the flexible substrate (e.g., foam), and in some embodiments an adhesive, is attached to the RFID assembly. The substrate may be a flexible substrate using any of a variety of suitable substrate materials, for instance including foam, plastic (polymers), paper, or cardboard. The flexible material substrate may be part of a roll or sheet of substrate material. Alternatively the substrate may be made of a rigid material.

In some embodiments, the printing and/or RFID device formation steps may be done with the flexible substrate being part of a sheet of material (such as a roll material) having substrate material for numerous devices.

At 320 the RFID assembly and attached substrate is cut. More specifically, each section of the conductive material that includes, for example two antennas and one (or two) RFID integrated circuits an attached to a substrate) is cut from the end of the roll. At 325 the cut RFID assembly and substrate may be folded to form the RFID device. In some embodiments, such as that illustrated in FIG. 5, the folding 325 may be omitted. In other embodiments, the order of these processes may be different and/or include fewer, different, or additional processes. Finally, in some embodiments the RFID device may then be enclosed in an enclosure to form a wearable tag such as a wristband, belt attachment, neck pendant, or other wearable item.

It will appreciated that the RFID device may include additional layers, such as protective layers, printable layers, layers, adhesive layers, and/or layers that provide structural properties.

The example embodiments of the present invention described herein allow the use of different frequencies which may each have advantages other the other. For example, the water/humidity tolerance characteristics of HF RFID give HF communications advantages for applications that involve high water-content items and/or humidity. UHF may permit more distant communications than HF.

UHF RFID systems typically communicate using frequencies in the range of 866 MHz to 915 MHz (or 902-928 MHz in North America) with a maximum read range of 10 meters. HF RRID systems often communicate at or about 13.56 MHz and have a shorter maximum read range.

Various embodiments of the present invention may comprise RFID devices that may be characterized as passive, semi-passive, or active RFID devices. Passive RFID devices have no internal power supply. Power for operation of passive RFID devices is provided by the energy in an incoming radio frequency signal received by the device. Most passive RFID devices signal by backscattering the carrier wave from an RF reader.

Active RFID devices have their own internal power source, which is used to power an integrated circuit in the device, and broadcast a separate signal. Active RFID devices may be more reliable than passive RFID devices. There may be fewer errors in communication between active tags and readers. Active tags may also transmit at higher power levels than passive RFID devices.

Semi-passive RFID devices also have a power source, but unlike active devices this power source is only used to provide that energy for internal operation of the device. In other words, semi-passive devices do not broadcast their own signals, as active RFID devices do. Semi-passive RFID devices usually communicate in a manner similar to that of passive RFID devices, by backscattering an incoming RF carrier signal.

Embodiments of the present invention may include various sensing capabilities such as humidity, pressure, shock, or light, which can readily be added to a sensor design by using an integrated circuit that can work with any resistive sensor or has more than one input.

The term integrated circuit is intended to encompass the broad range of devices, which may vary in complexity and functionality. The antenna may be any of variety of antennas of any suitable geometry and configuration for providing the desired coupling, reception and transmission of signals.

It is to be understood that the foregoing illustrative embodiments have been provided merely for the purpose of explanation and are in no way to be construed as limiting of the invention. Words used herein are words of description and illustration, rather than words of limitation. In addition, the advantages and objectives described herein may not be realized by each and every embodiment practicing the present invention. Further, although the invention has been described herein with reference to particular structure, materials and/or embodiments, the invention is not intended to be limited to the particulars disclosed herein. Rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention.

What is claimed is:

1. A dual band antenna device, comprising:

a planar conductive sheet;

a slot antenna formed in the conductive sheet;

said slot antenna configured to communicate at a first frequency;

an HF inlay and an UHF inlay;

where at least a portion of the HF inlay is under the UHF inlay;

a multi-turn antenna formed in the conductive sheet;

said multi-turn antenna configured to communicate in a second frequency that is different from the first frequency, wherein the multi-turn antenna appears as a solid plane at UHF frequencies and forms a portion of said slot antenna; and one or more integrated circuits connected to said multi-turn antenna and said slot antenna;

a material connected to one of said one or more integrated circuits; and wherein said material is configured to cause said one of said one or more integrated circuits to store information in a memory in response to application of a predetermined pressure.

2. The dual band antenna device of claim 1, wherein the dual band antenna communicates in HF and UHF.

3. The dual band antenna device of claim 1, further comprising a separator.

4. The dual band antenna device of claim 1, wherein the integrated circuit is a two-port integrated circuit.

5. The dual band antenna device of claim 1, wherein a first integrated circuit is connected to the slot antenna and a second integrated circuit is connected to the multi-turn antenna.

6. The dual band antenna device of claim 1, wherein an assembly of the slot antenna is co-extensive with an assembly of the multi-turn antenna when the device is folded.

7. The dual band antenna device of claim 1, wherein the slot and multi-turn antennas are attached to a substrate.

8. The dual band antenna device of claim 7, wherein the substrate is a foam, paper, or corrugated cardboard.

9. The dual band antenna device of claim 1, wherein the device has sensing capabilities.

10. The dual band antenna device of claim 1, wherein the dual band antenna device is enclosed in a wearable enclosure.

11. The dual band antenna device of claim 1, wherein the device is created flat.

12. The dual band antenna device of claim 1, wherein the device includes at least one integrated circuit and the at least one integrated circuit includes circuitry to choose an antenna with which to communicate.

13. The dual band antenna device of claim 1, wherein at least one of the multi-turn antenna or the slot antenna is a HF antenna with wave shape or interdigital cuts between elements of the HF antenna.

* * * * *